US010531712B2

(12) United States Patent
Ogura

(10) Patent No.: US 10,531,712 B2
(45) Date of Patent: Jan. 14, 2020

(54) SEALING FOR OPEN-END SLIDE FASTENERS

(71) Applicant: YKK Corporation, Tokyo (JP)

(72) Inventor: Suguru Ogura, Macon, GA (US)

(73) Assignee: YKK Corporation (JP)

( * ) Notice: Subject to any disclaimer, the term of this patent is extended or adjusted under 35 U.S.C. 154(b) by 376 days.

(21) Appl. No.: 15/284,394

(22) Filed: Oct. 3, 2016

(65) Prior Publication Data

US 2018/0092442 A1 Apr. 5, 2018

(51) Int. Cl.

| | |
|---|---|
| ***A44B 19/38*** | (2006.01) |
| ***A44B 19/32*** | (2006.01) |
| ***A44B 19/04*** | (2006.01) |

(52) U.S. Cl.

CPC ..... *A44B 19/38* (2013.01); *A44B 19/04* (2013.01); *A44B 19/32* (2013.01)

(58) Field of Classification Search

CPC ..... A44B 19/38; A44B 19/04; A44B 19/32
See application file for complete search history.

(56) References Cited

U.S. PATENT DOCUMENTS

| | | | | |
|---|---|---|---|---|
| 2,928,155 | A | 3/1960 | Kallio | |
| 4,112,553 | A | 9/1978 | Weitzner | |
| 5,608,952 | A | 3/1997 | Wilder | |
| 5,697,130 | A | 12/1997 | Smith | |
| 6,481,068 | B1 | 11/2002 | Takasawa | |
| 6,502,285 | B2 | 1/2003 | Kiely | |
| 7,036,191 | B2 * | 5/2006 | Tsaur | A44B 19/388 24/433 |
| 8,844,101 | B2 | 9/2014 | Nozaki et al. | |
| 2005/0278904 | A1 | 12/2005 | Matsumoto et al. | |
| 2007/0074380 | A1 | 4/2007 | Matsumoto et al. | |
| 2007/0226965 | A1 | 10/2007 | Cossutti | |
| 2012/0000040 | A1 | 1/2012 | Ogura | |
| 2012/0260470 | A1 | 10/2012 | Keyaki et al. | |
| 2016/0021990 | A1 | 1/2016 | Ogura et al. | |

FOREIGN PATENT DOCUMENTS

| | | |
|---|---|---|
| CN | 101077239 A | 11/2007 |
| CN | 1021066630 A | 6/2011 |
| EP | 1481601 | 5/2008 |
| JP | 63-073014 U | 5/1988 |
| JP | 63-124806 U | 8/1988 |

(Continued)

OTHER PUBLICATIONS

Non-Final Office Action, U.S. Appl. No. 14/337,887, dated Dec. 4, 2015, 6 pages.

(Continued)

*Primary Examiner* — Robert Sandy
*Assistant Examiner* — Louis A Mercado
(74) *Attorney, Agent, or Firm* — Kilpatrick Townsend & Stockton LLP

(57) ABSTRACT

Open-ended slide fastener assemblies with improved operability. In some examples, the slide fastener assemblies are watertight and/or airtight. The slide fastener assemblies include one or more sliders and box and pin mechanisms integrated with the slide fastener. The pin mechanism need not be inserted into the box at the same time it is inserted into the slider, permitting the slide fastener to be operated even when it is not visible or easily accessible.

17 Claims, 13 Drawing Sheets

(56) References Cited

FOREIGN PATENT DOCUMENTS

| | | | |
|---|---|---|---|
| JP | H01-313001 | A | 12/1989 |
| JP | H10-124005 | A | 5/1995 |
| JP | H10-104303 | A | 7/1998 |
| JP | 2005-021667 | A | 1/2005 |
| JP | 2006-000468 | A | 1/2006 |
| JP | 2006-296732 | A | 11/2006 |
| TW | I248796 | B | 2/2006 |
| TW | I309157 | B | 5/2009 |
| WO | 2010/109656 | A1 | 9/2010 |
| WO | 2011/077544 | A1 | 6/2011 |

OTHER PUBLICATIONS

Office Action, Japanese Patent Application No. 2015-137113, dated May 24, 2016 (3 pages of Japanese Office Action, 4 pages of English translation).
Office Action, Taiwanese Patent Application No. 104123740, dated Jul. 13, 2016 (15 pages of Taiwanese Office Action, 11 pages of English translation).
International Search Report, PCT Application No. PCT/JP2017/033418, dated Nov. 21, 2017.
Written Opinion, PCT Application No. PCT/JP2017/033418, dated Nov. 21, 2017.

* cited by examiner

SEALING FOR OPEN-END SLIDE FASTENERS

FIELD OF THE INVENTION

Improved open-end slide fasteners that are, in some non-limiting examples, watertight and/or airtight.

BACKGROUND

A slide fastener is used to secure two pieces of fabric or other flexible material. A slide fastener includes a slider that engages with elements located on tapes to open and close the slide fastener. When the slider is moved along the tape, a generally Y-shaped channel meshes together rows of opposing elements of the tapes to close the slide fastener. When the slider is moved in the opposite direction, the generally Y-shaped channel separates the rows of opposing elements to open the slide fastener.

An open-ended slide fastener often includes a box and pin mechanism at one end of the tapes to align the slider properly with respect to the elements of the two tapes so that the slide fastener may open and close properly. The other end of the tapes may include a top stop, which receives the slider when in the closed position and prevents the slider from sliding off the ends of the tapes.

SUMMARY

The terms "invention," "the invention," "this invention" and "the present invention" used in this patent are intended to refer broadly to all of the subject matter of this patent and the patent claims below. Statements containing these terms should be understood not to limit the subject matter described herein or to limit the meaning or scope of the patent claims below. Embodiments of the invention covered by this patent are defined by the claims below, not this summary. This summary is a high-level overview of various aspects of the invention and introduces some of the concepts that are further described in the Detailed Description section below. This summary is not intended to identify key or essential features of the claimed subject matter, nor is it intended to be used in isolation to determine the scope of the claimed subject matter. The subject matter should be understood by reference to appropriate portions of the entire specification of this patent, any or all drawings and each claim.

Disclosed are open-ended slide fasteners with box and pin mechanisms that are configured to facilitate ease of assembly and operation. In some examples, the slide fastener can be operated when the user has limited or no visibility of some or all of the slide fastener. In some cases, the box and pin mechanisms are configured to compress the tape edges and create a water and air tight seal, thus eliminating the need for installing a separate component after the slide fastener has been manufactured.

BRIEF DESCRIPTION OF THE DRAWINGS

Illustrative examples of the present invention are described in detail below with reference to the following drawing figures.

DETAILED DESCRIPTION

Disclosed are improved open-end slide fastener assemblies that are easily operated, even when the user has limited visibility of the slide fastener assembly. In some cases, the slide fastener assemblies are configured to be water and/or air tight without requiring the installation of additional, separate parts after the tapes have been manufactured. For example, the slide fastener assembly 8 shown in the Figures includes integrated top stops and box and pin assemblies that are configured to form a water and/or air tight seal. The disclosed assemblies are particularly well suited for open-end configurations where the tapes are separate from one another when their elements are not engaged.

Figure 1:
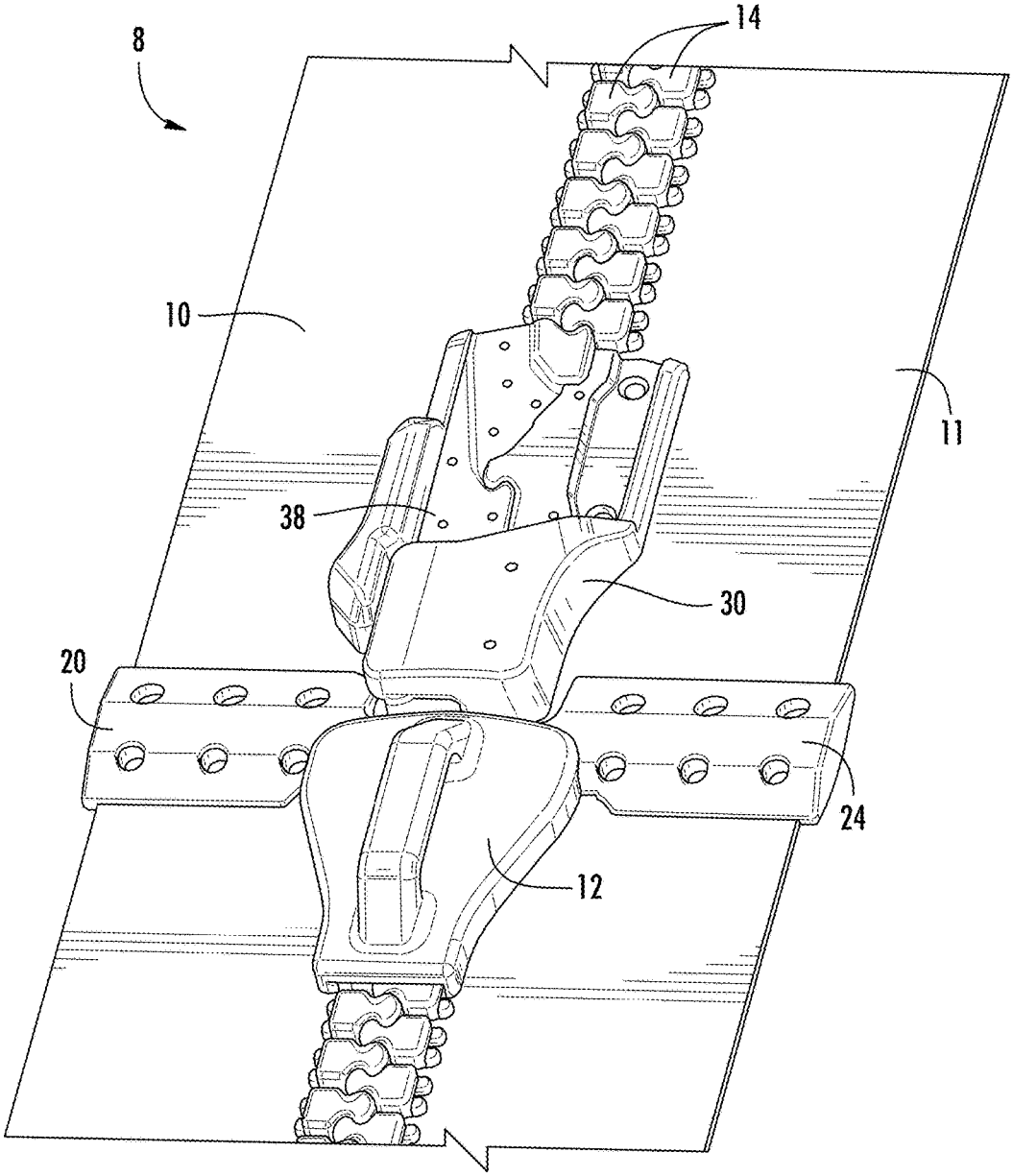
FIG. 1 is a perspective view of a slide fastener assembly according to one example, shown in the closed position.
Figure 2:
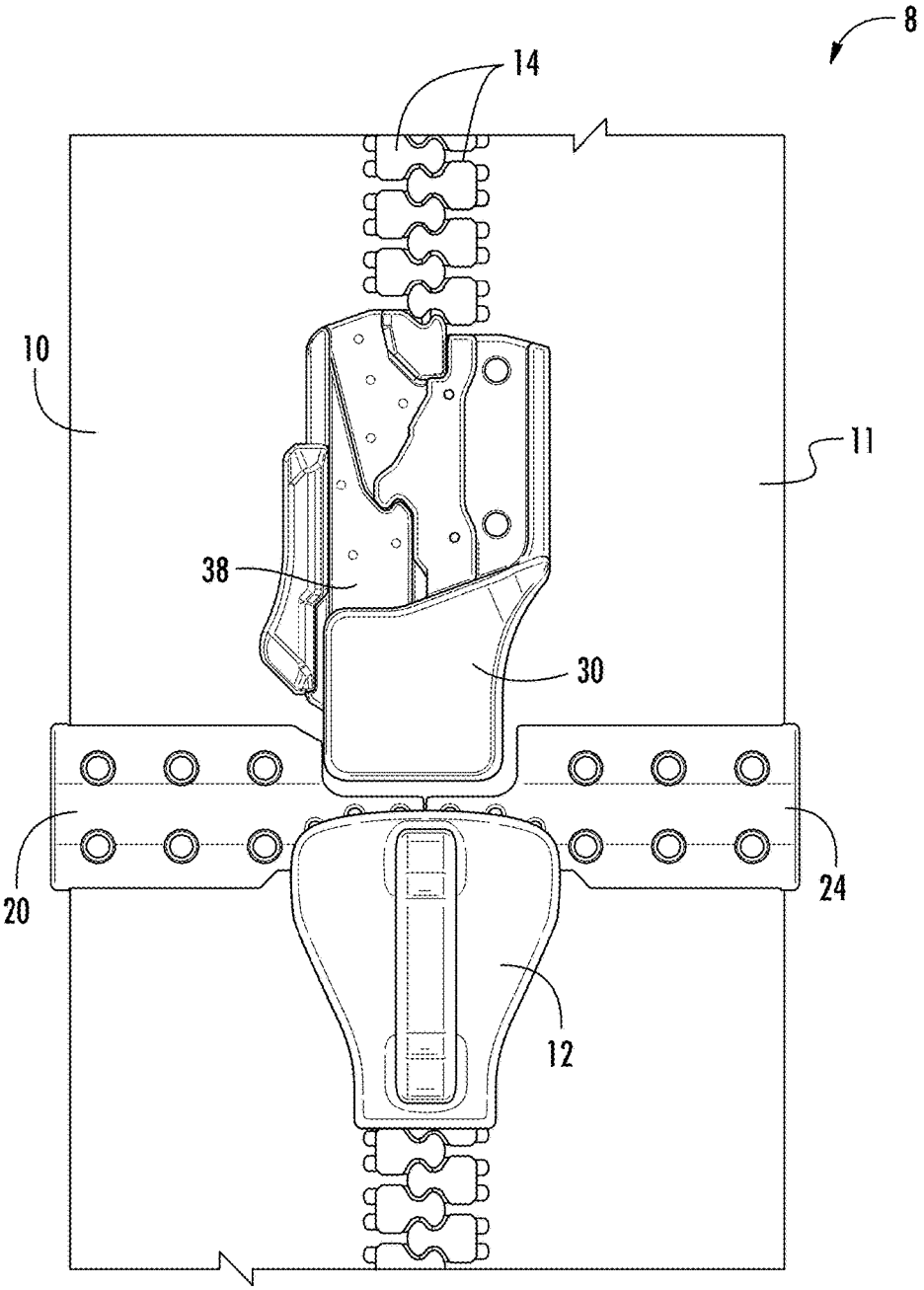
FIG. 2 is a front view of the slide fastener assembly of FIG. 1.

As shown in FIGS. 1-2, slide fastener assembly 8 includes a first tape 10, which may be attached to a first article, and a second tape 11, which may be attached to a second article or another part of the first article. In some examples, the tapes 10, 11 are coated with polyurethane or other suitable material. Because the tapes 10, 11 are separate from one another when their elements are unengaged (i.e., they are part of an open-ended slide fastener), they are well suited for use on articles of clothing that are separate from one another, such as an air and/or water tight suit having a jacket and pants. Some non-limiting applications of the disclosed slide fastener assemblies include kayak suits, rain suits, wet suits, dry suits, emergency suits, etc.

The two ends of first tape 10 may join together into a loop and the two ends of second tape 11 may join together into a loop, although they need not. In some examples, the two ends of each tape 10, 11 are attached by injection molding that connects the two ends of first tape 10 with a first extension 20 and the two ends of second tape 11 with a second extension 24 (see FIGS. 1-2). When elements 14 of the two tapes 10, 11 are coupled together (i.e., the slide fastener assembly 8 is in the closed position), the slide fastener assembly 8 may also form a loop in some cases, although it need not.

To open and close slide fastener assembly 8, slider 12 (FIGS. 14-18) cooperates with elements 14 located on first and second tapes 10, 11. As shown in FIGS. 14-18, slider 12 typically includes a slider body, such as a slider body 60, and a pull tab (not shown) that attaches to the slider body in a known manner. The slider body 60 can be of conventional construction so that the top and bottom wings are generally similar in shape and size, although they need not be. As shown in FIGS. 14-18, slider body 60 includes a top wing 66 and a bottom wing 68 that are spaced apart from one another and joined at the front 70 by a connecting neck 72 (sometimes referred to as a diamond) to form a generally Y-shaped guide channel 64. The connecting neck 72 includes a leading portion 74. Pillar 62, around which a pull tab can be pivot, extends from the top wing 66. Flanges 76 extend from the top wing 66 and the bottom wing 68. When the slider 12 is moved in one direction, the generally Y-shaped guide channel 64 meshes together rows of opposing elements of the tapes. When the slider 12 is moved in the opposite direction, the generally Y-shaped guide channel 64 separates the rows of opposing elements.

Figure 3:
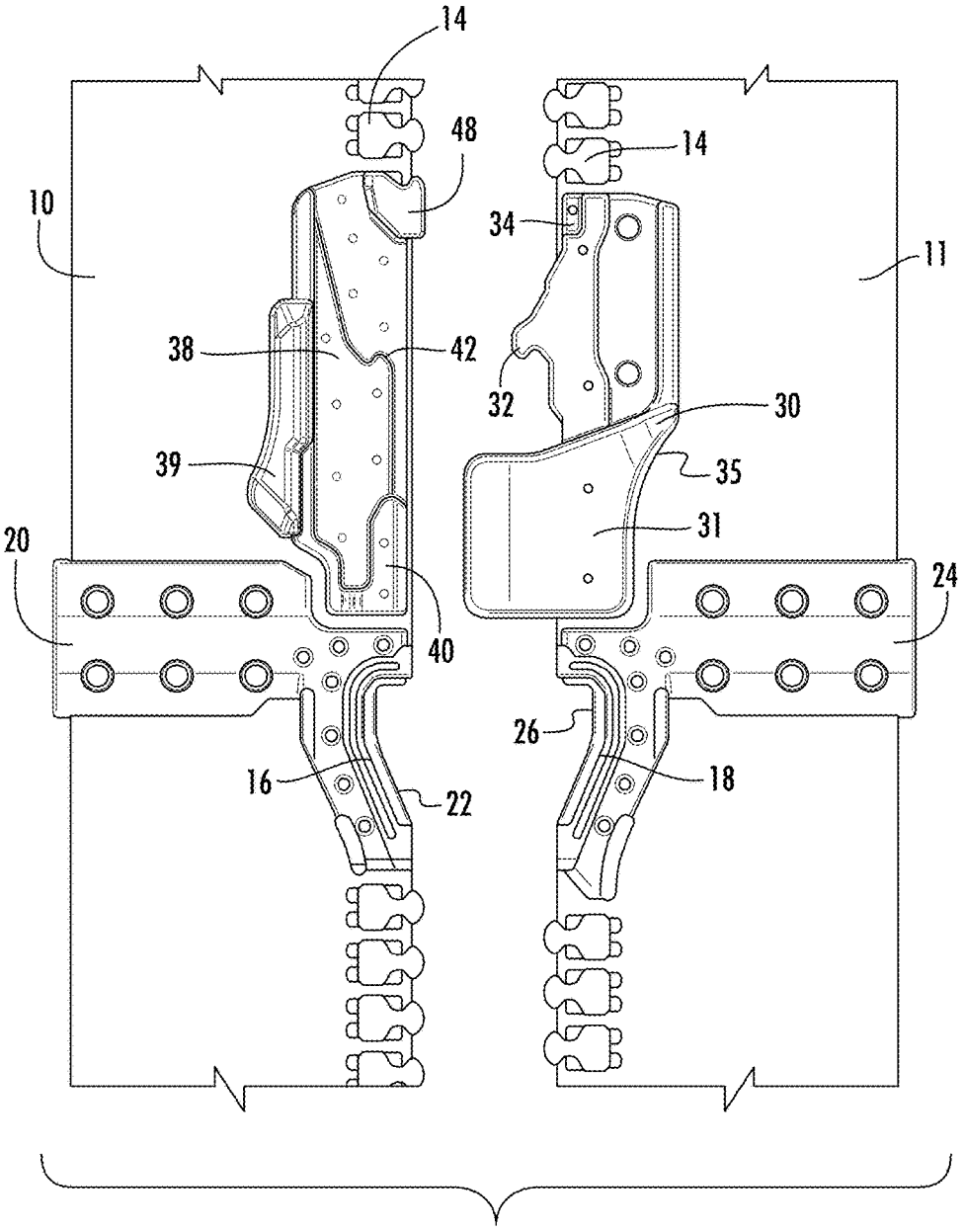
FIG. 3 is a front view of a portion of the slide fastener assembly of FIG. 1, shown in the open position and shown without the slider.
Figure 25:
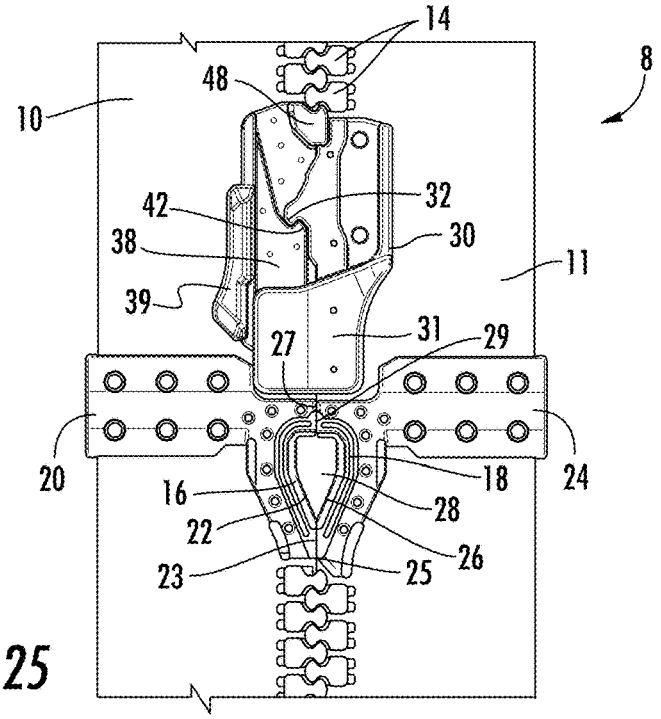
FIG. 25 illustrates the full engagement of the pin of FIG. 9 with the box of FIG. 6, shown without the slider.

As shown in FIG. 3, first extension 20 that joins the two ends of first tape 10 may extend laterally from a first top stop 16 associated with first tape 10. Similarly, second extension 24 that joins the two ends of second tape 11 may extend laterally from a second top stop 18 associated with second tape 11. As shown in FIG. 25, when edge 22 of the first top stop 16 abuts edge 26 of the second top stop 18, the first top stop 16 and the second top stop 18 form a cavity 28 configured to receive the connecting neck 72 of slider 12. In this way, the first top stop 16 and the second top stop 18 cooperate with a slider, such as slider 12 shown in FIGS. 1-2 and 14-18, to limit the traversal of the slider 12 along the tapes 10, 11. In addition, the top stops 16, 18 are configured to engage with the slider 12 such that no gaps exist between the top stops 16, 18 and the slider 12 so that water and/or air is prevented from penetrating the slide fastener assembly 8. In particular, the top stops 16, 18 are compressed against each other and with slider 12 to maintain the water and air tight characteristics of the slide fastener assembly 8.

As shown in FIG. 3, the first top stop 16 is positioned with respect to a pin 38 of tape 10 and the second top stop 18 is positioned with respect to a box 30 of tape 11. As discussed in more detail below, the pin 38 engages with the box 30 to align the slider 12 properly with respect to two otherwise-separate tapes 10, 11 so that the slide fastener assembly 8 may open and close properly. The box 30 and the pin 38 may be formed of any suitable flexible material, including for example, any suitable polymer like Nylon® or an elastomer such as a thermoplastic elastomer or any other suitable material. In some examples, the box 30 and the pin 38 are formed of the same material as the elements 14 and/or the top stops 16, 18, although they need not be.

Figure 5:
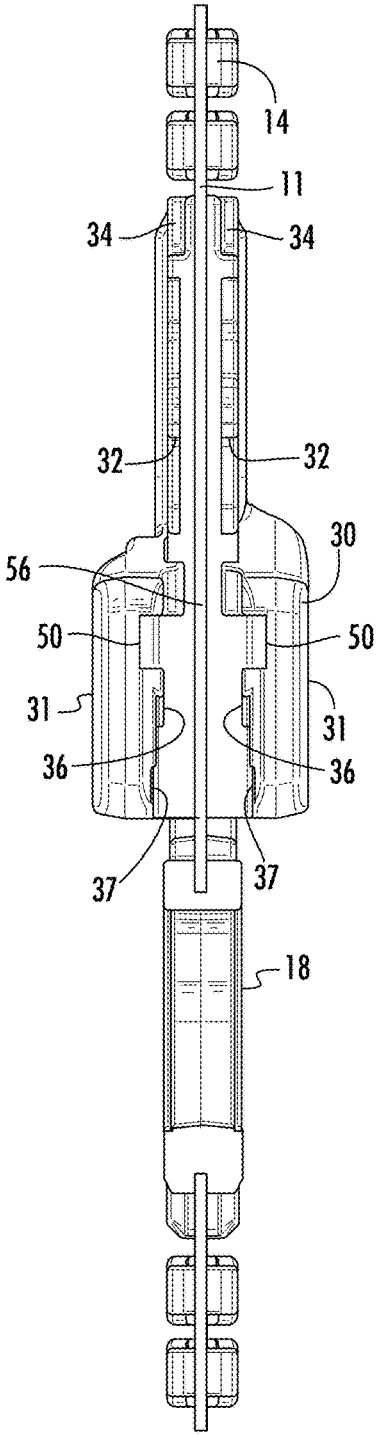
FIG. 5 is a side view of a portion of a second of the tapes of the slide fastener assembly of FIG. 1.
Figure 6:
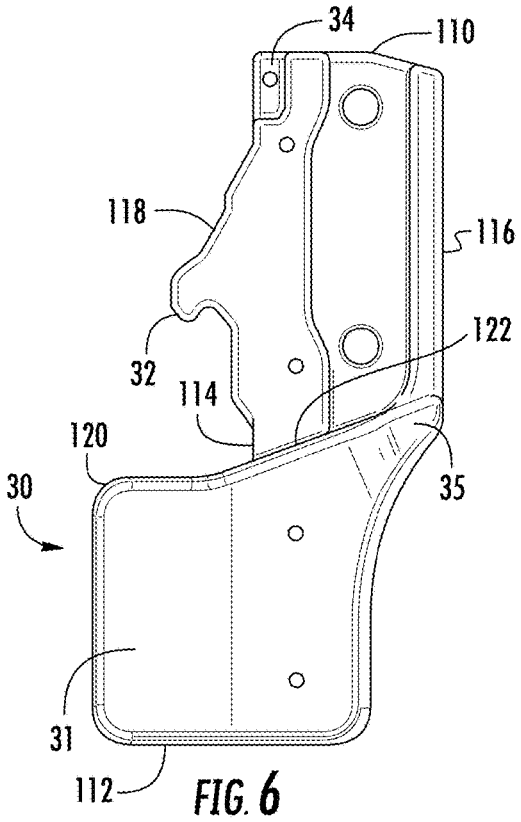
FIG. 6 is a front view of the box of the slide fastener assembly of FIG. 1.
Figure 7:
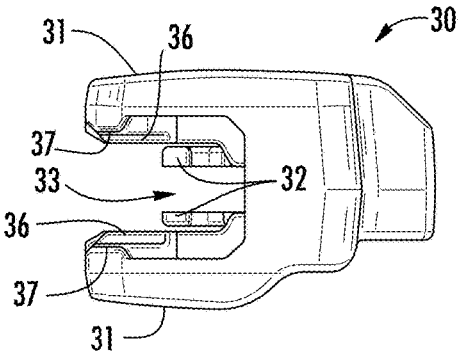
FIG. 7 is an end view of the box of FIG. 6.
Figure 8:
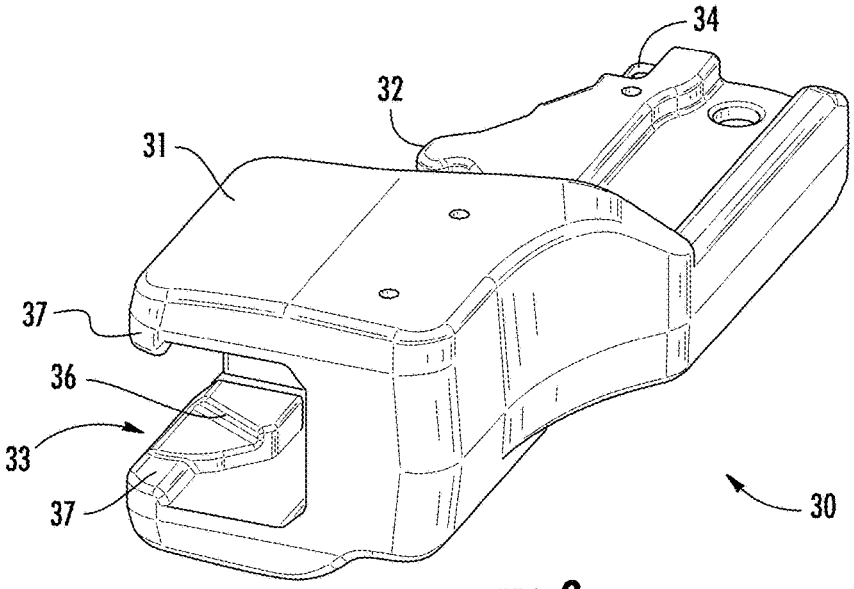
FIG. 8 is a perspective end view of the box of FIG. 6.

As shown in FIG. 6, the box 30 has a top edge 110, a bottom edge 112, a first lateral edge 114 and a second lateral edge 116. In the illustrated example, part of the first lateral edge 114 forms a contour 118. The box 30 also includes two portions 31 associated with opposites sides of second tape 11, where inner surfaces of portions 31 are separated from one another by a cavity 33. In other examples, only one portion 31 is present. Each inner surface of the portions 31 includes an upper strength member 36 and a lower snap mechanism 37 that are stepped relative to one another. The lower snap mechanism 37 is configured to generate tactile feedback, as discussed below, while the upper strength member 36 helps maintain the cross-wise strength of the slide fastener assembly 8. As shown in FIG. 5, cavity 33 also includes two optional recesses 50 that may facilitate removal of the box 30 from the mold in which it is formed.

Each portion 31 includes a handle area 35 (FIG. 6) that facilitates grasping and handling of the box 30. Moreover, the contour 118 includes an engaging portion 32, discussed below, that is positioned between the box top edge 110 and an edge 120 adjacent the top of the cavity 33. The edge 120 is angled and includes a straight portion 122 that is similar in length or greater than the width of the rear mouth 80 of the slider (see FIG. 15). As shown in FIGS. 3, 5, 6 and 8, a recessed guide element 34 extends from the box 30, and a plurality of elements 14 are adjacent guide element 34 (see, e.g., FIG. 3).

Figure 9:
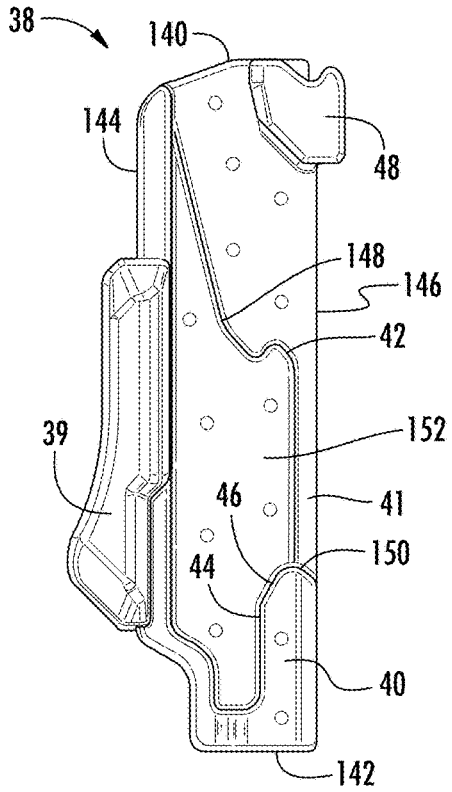
FIG. 9 is a front view of the pin of the slide fastener assembly of FIG. 1.
Figure 11:
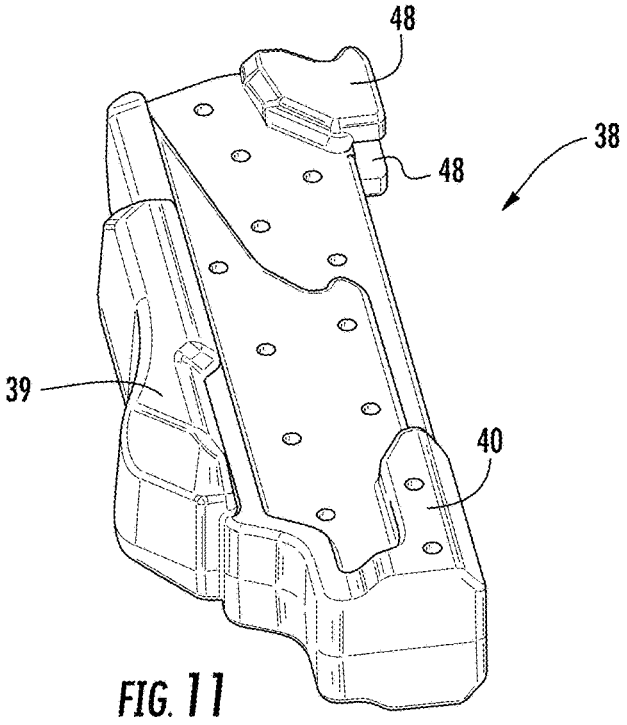
FIG. 11 is a perspective end view of the pin of FIG. 9.
Figure 12:
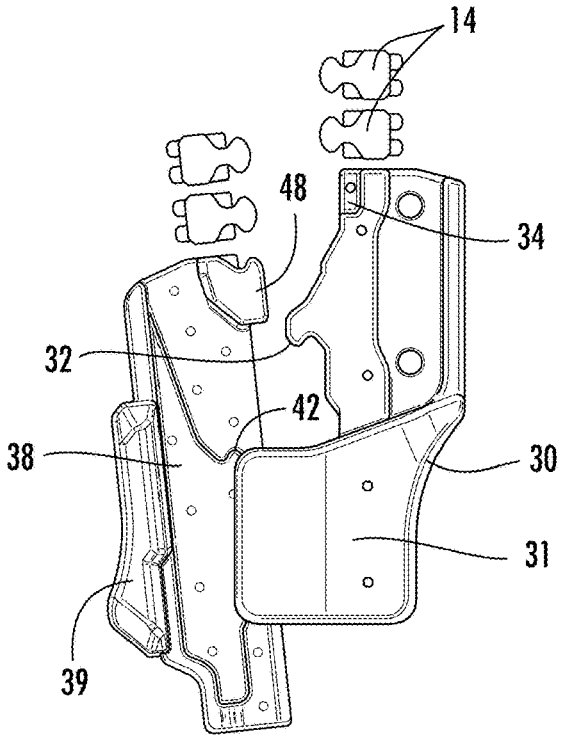
FIG. 12 illustrates the initial engagement of the pin of FIG. 9 with the box of FIG. 6, in isolation.
Figure 13:
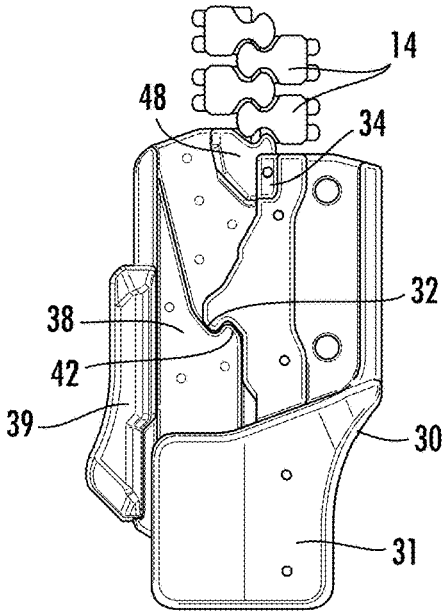
FIG. 13 illustrates the engagement of the pin of FIG. 9 with the box of FIG. 6, in isolation.
Figure 14:
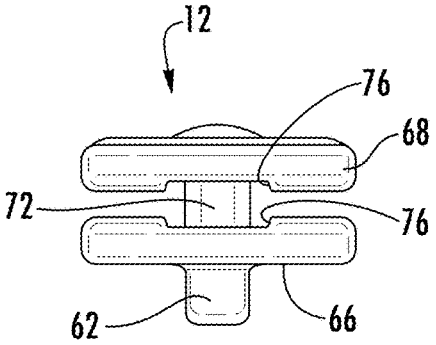
FIG. 14 is an end view of a slider according to one example.
Figure 15:
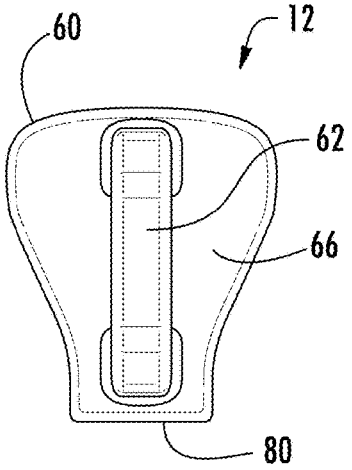
FIG. 15 is a front view of the slider of FIG. 14.
Figure 16:
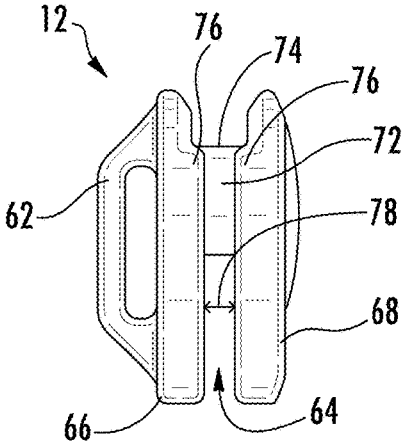
FIG. 16 is a side view of the slider of FIG. 14.
Figure 17:
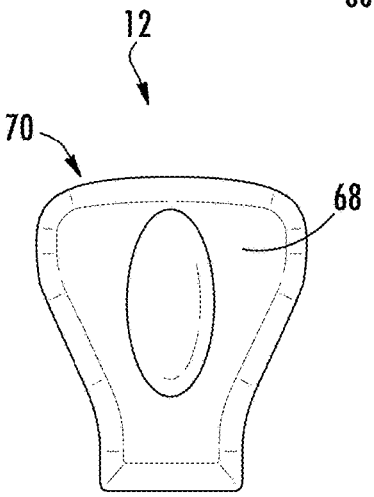
FIG. 17 is a rear view of the slider of FIG. 14.
Figure 18:
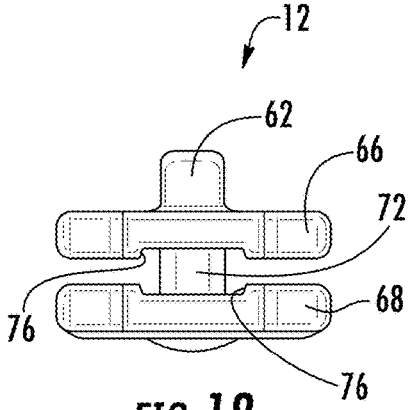
FIG. 18 is another end view of the slider of FIG. 14.

As shown in FIGS. 12-13, the box 30 is configured to engage the pin 38. Pin 38 is illustrated in FIGS. 4 and 9-11. The pin 38 includes a top edge 140, a bottom edge 142, a first lateral edge 144, and a second lateral edge 146. As shown in FIG. 9, the pin 38 also includes two faces 41 associated with opposite sides of tape 10, although in other examples, only one face 41 is present. Each of the faces 41 includes an insertion area 40 that extends upwardly from the face 41 and that is configured to be received within the cavity 33 of the box 30, as illustrated in FIGS. 12-13. The insertion area 40 is raised relative to an outer surface 152 of the pin 38 and includes an edge 44 with a taper 46. When the insertion area 40 is received within the cavity 33, the edge 44 of the insertion area 40 is adjacent the upper strength member 36 and the lower snap mechanism 37 of the cavity 33. The taper 46 helps facilitate movement of the insertion area 40 along the stepped upper strength member 36 and the lower snap mechanism 37.

Each of the faces 41 also includes a contour 148. Contour 148 in the illustrated example is positioned between the first lateral edge 144 and the second lateral edge 146. Contour 148 includes an engaging portion 42 that is positioned between the top edge 140 of the pin 38 and a top edge 150 of the insertion area 40. The engaging portion 42 is configured to cooperate with a respective one of the engaging portions 32 of the box 30 as the pin 38 moves from the initially engaged position (FIG. 12) into the received position (FIG. 13). Engagement of the engaging portions 32, 42 (see FIG. 13) helps secure the box-pin assembly in the received position.

Figure 10:
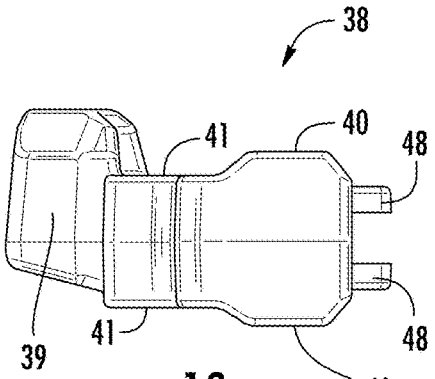
FIG. 10 is an end view of the pin of FIG. 9.

As shown in FIGS. 9-11, the pin 38 also includes a handle portion 39 that facilitates grasping and insertion of the insertion area 40 of the pin 38 into the cavity 33. A half element 48 extends from each face 41 of the pin 38. With reference to FIG. 13, the half element 48 is shaped and sized so that at least a portion of the half element 48 is received within the guide element 34 of box 30 and a portion cooperates with the element 14 adjacent the guide element 34 when the pin 38 is fully engaged with the box 30 and is in the received position. In some cases, as shown in FIG. 13, the half element 48 is received within the guide element 34 at an approximately right angle.

Figure 19:
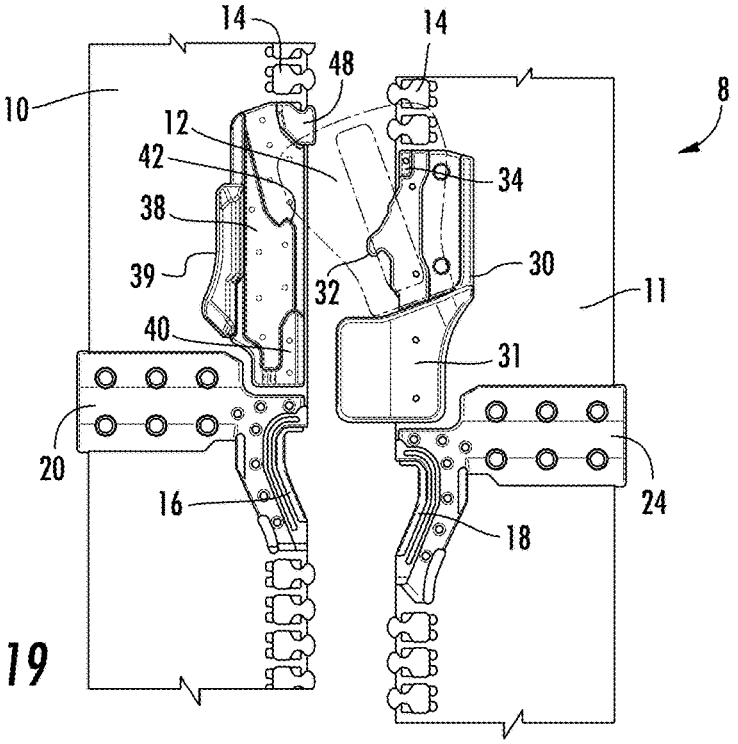
FIG. 19 illustrates a step of operating the slide fastener assembly of FIG. 1, in which the pin of FIG. 9 is positioned with respect to the box of FIG. 6, as the slider (shown in phantom lines) is aligned with the elements.

FIGS. 19-24 illustrate operation of the slider 12 as it engages with the pin 38 and the box 30. First, the pin 38 is positioned with respect to the box 30 as the slider 12 is aligned with the elements 14, but the pin 38 does not need to be inserted into the box 30 in the same step it is inserted into the slider 12. This increases the ease of use of the slide fastener assembly 8 and allows the slide fastener assembly 8 to be operated when the user has limited or no visibility of the slide fastener assembly 8. In particular, as shown in FIGS. 19-22, the pin 38 is received between the flanges 76 of the slider 12 so that the half element 48 is proximate the slider 12. FIG. 19 illustrates a step of operating the slide fastener assembly 8, in which the pin 38 is inserted into only the slider 12 and the rear mouth 80 of the slider 12 rests against the straight portion 122 of the edge 120 of the box 30. In this way, the edge 120 of box 30 helps support and position the slider 12.

Figure 20:
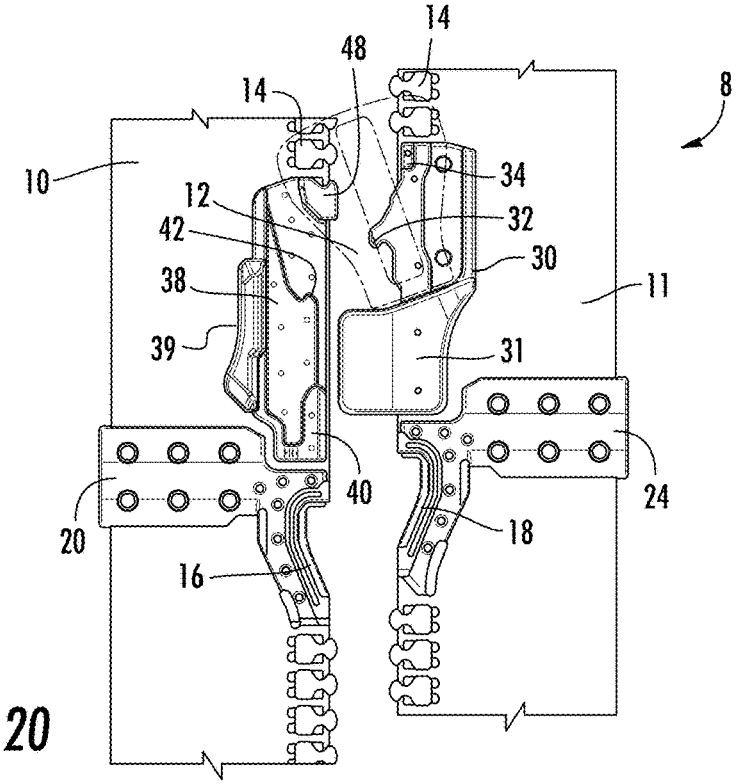
FIG. 20 illustrates a subsequent step of operating the slide fastener assembly of FIG. 1, in which the pin of FIG. 9 is positioned to engage the box of FIG. 6, with the slider (shown in phantom lines) at a first end of the tape.
Figure 21:
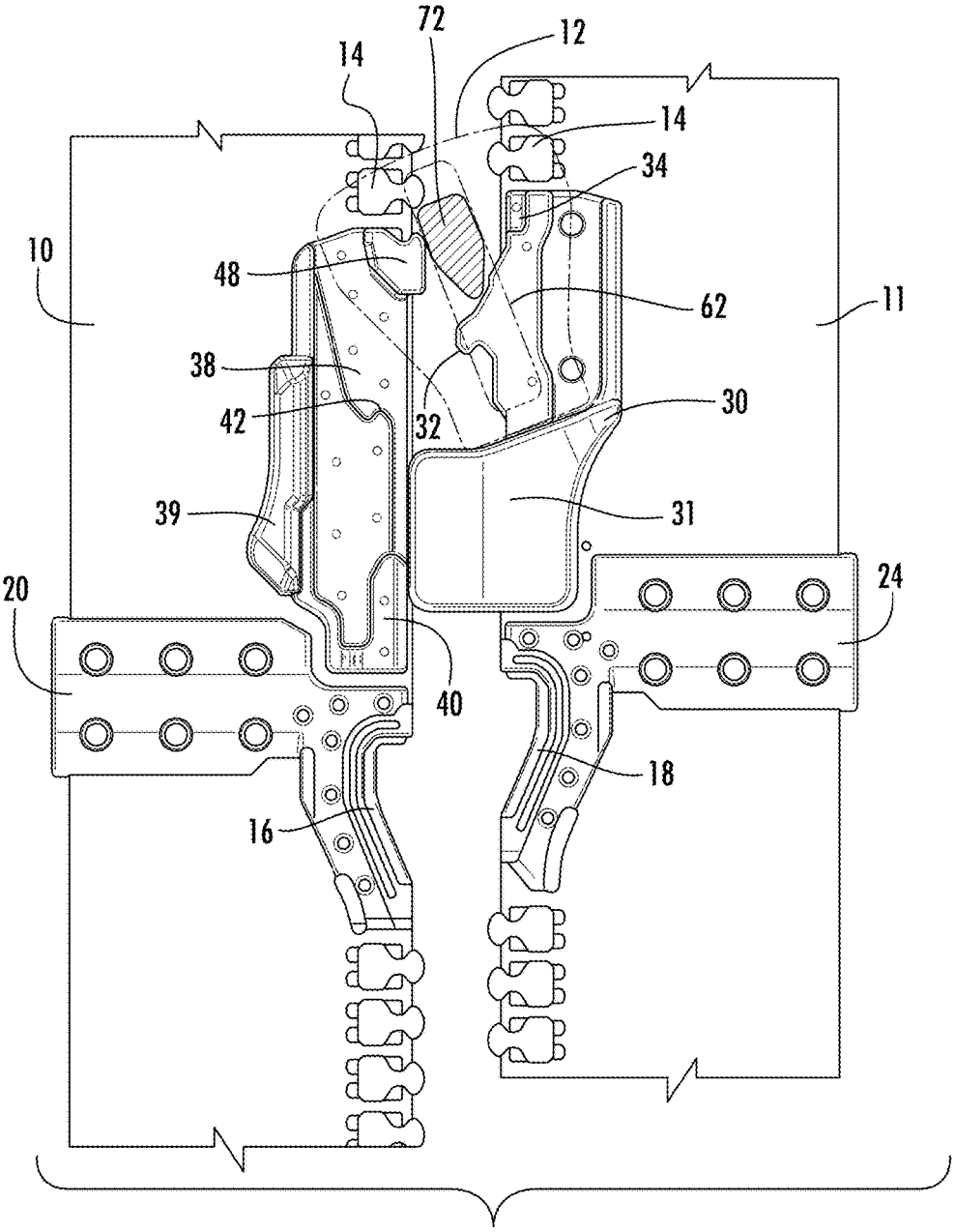
FIG. 21 illustrates a subsequent step of operating the slide fastener assembly of FIG. 1, in which the pin of FIG. 9 is positioned to engage the box of FIG. 6, with the slider (shown in phantom lines) at a first end of the tape.

FIGS. 20-21 illustrate the pin 38 as received within the flanges 76 of the slider 12 and the insertion area 40 as it is aligned with respect to cavity 33 of the box 30 before it is inserted into the cavity 33. FIG. 21 illustrates how the connecting neck 72 of the slider 12 engages the half element 48 to help properly position the slider 12 with respect to the box 30. Connecting neck 72 is shown with crosshatching in FIG. 21 for illustration purposes, while the remainder of the slider 12 is shown in phantom lines.

Figure 22:
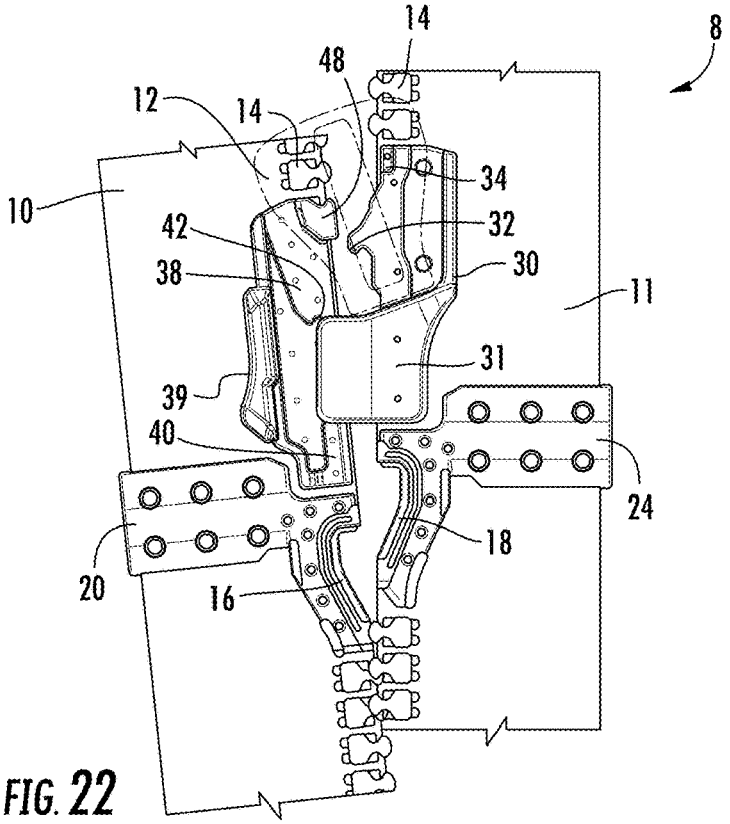
FIG. 22 illustrates a subsequent step of operating the slide fastener assembly of FIG. 1, in which the pin of FIG. 9 engages with the box of FIG. 6, with the slider (shown in phantom lines) at a first end of the tape.

FIG. 22 illustrates the initial engagement of the pin 38 with the box 30 as at least part of the insertion area 40 is inserted into the cavity 33 of the box 30. Grasping the handle portion 39 may facilitate insertion of at least part of the insertion area 40 into the cavity 33. As the raised insertion area 40 of the pin 38 rides over the lower snap mechanism 37 of the cavity 33 of the box 30, a tactile response such as a clicking feel and/or an audible snapping sound is generated, indicating that the pin 38 is properly received in the box 30. As shown in FIG. 22, a gap exists between an upper part of the pin 38 and an upper part of the box 30 when the slider 12 rests against the box 30, even after the insertion area 40 is received within the cavity 33.

Figure 23:
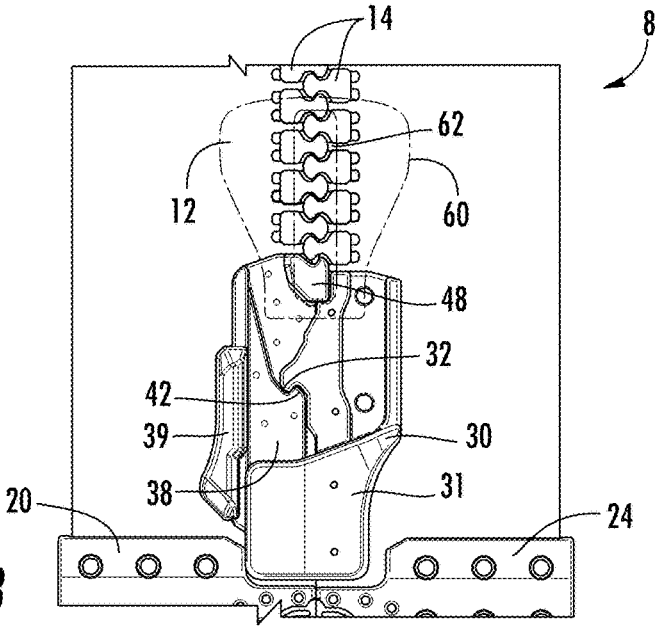
FIG. 23 illustrates a subsequent step of operating the slide fastener assembly of FIG. 1, in which the pin of FIG. 9 is fully engaged with the box of FIG. 6 as the slider (shown in phantom lines) moves away from the first end of the tape.

FIG. 23 illustrates the slide fastener assembly 8 after the slider 12 has moved along the elements 14 away from the pin 38/box 30 toward the top stops 16, 18. As shown in FIG. 23, moving the slider 12 upwards along the elements 14 past the box 30/pin 38 automatically moves the pin 38 into a fully engaged position with respect to the box 30. In particular, movement of the slider 12 past the pin 38/box 30 pulls other parts of the pin 38 (e.g., the upper part of the pin 38) into contact with the box 30 (e.g., the upper part of the box 30) such that the engaging portion 42 of the pin 38 abuts the engaging portion 32 of the box 30 and helps retain the pin 38 in the received position with respect to the box 30. FIG. 13 illustrates the pin 38 in the received position with respect to the box 30 but without the slider 12.

Figure 24:
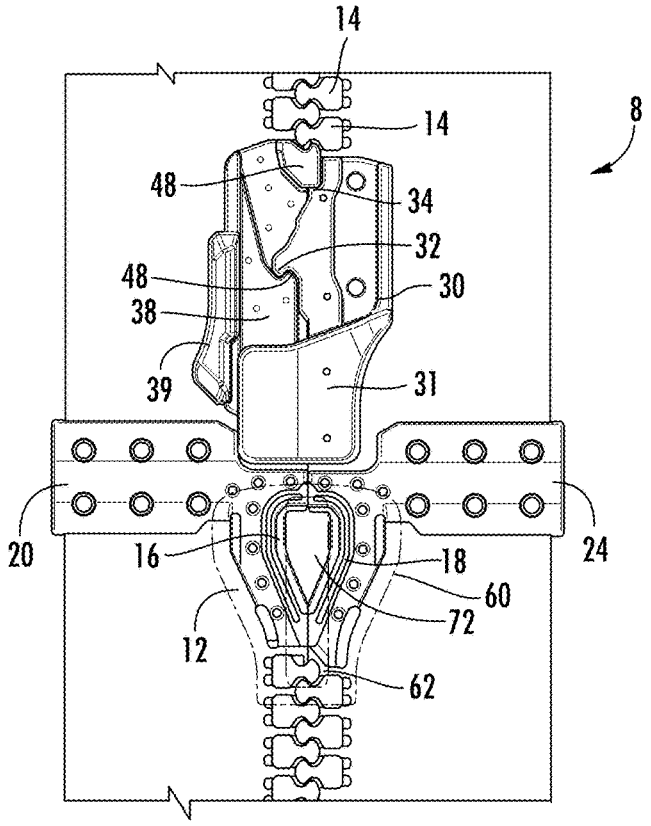
FIG. 24 illustrates the full engagement of the pin of FIG. 9 with the box of FIG. 6, with the slider at a second end of the tape and received within the top stop.

FIG. 24 illustrates the pin 38 fully engaged with the box 30 in the received positioned and with the slider 12 received within the cavity 28 of the top stops 16, 18. Even after the slider 12 has moved past the pin 38/box 30, as shown in FIG. 24, the pin 38 remains fully engaged with the box 30, with the engaging portion 32 abutting the engaging portion 42.

Figure 26:
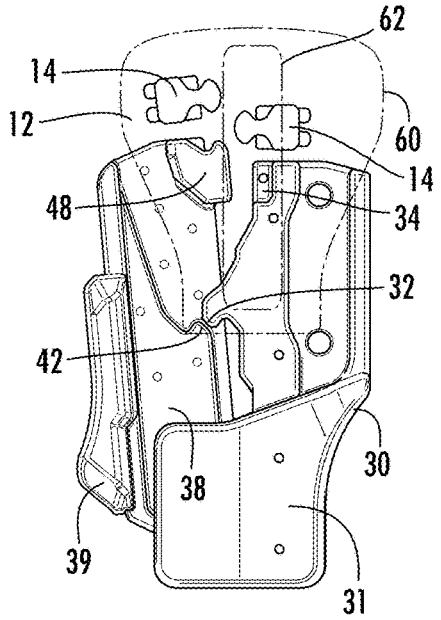
FIG. 26 illustrates the disengagement of the pin of FIG. 9 from the box of FIG. 6, with the slider shown in phantom lines.
Figure 27:
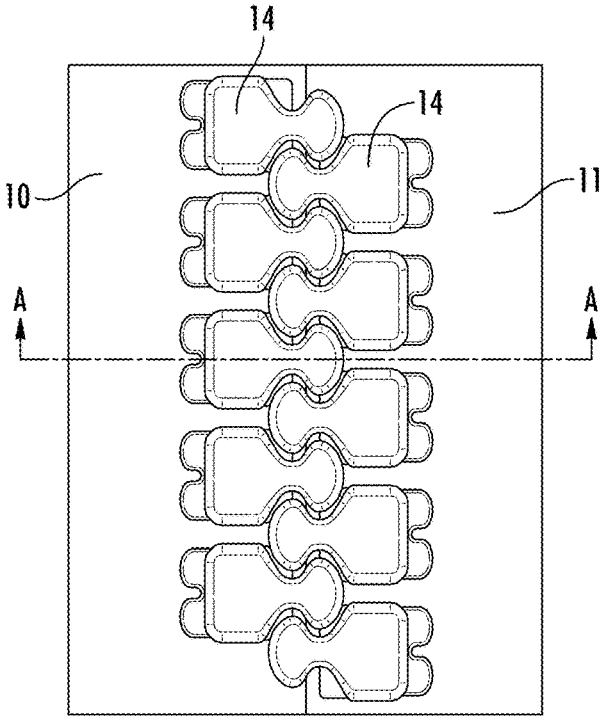
FIG. 27 is a front view of a portion of engaged elements of the slide fastener assembly of FIG. 1.

To automatically disengage the pin 38 from the box 30, the slider 12 moves downward along the elements 14 toward the pin 38/box 30 until the slider 12 contacts the pin 38, as illustrated in FIG. 26. Specifically, the slider 12 moving into the engaging portion 42 of the pin 38 interferes with the abutment of the engaging portion 42 of the pin 38 and the engaging portion 32 of the box 30 and releases the pin 38 from the box 30. Removal of the pin 38 from the box 30 allows the two tapes 10, 11 to be separated from one another.

Figure 4:
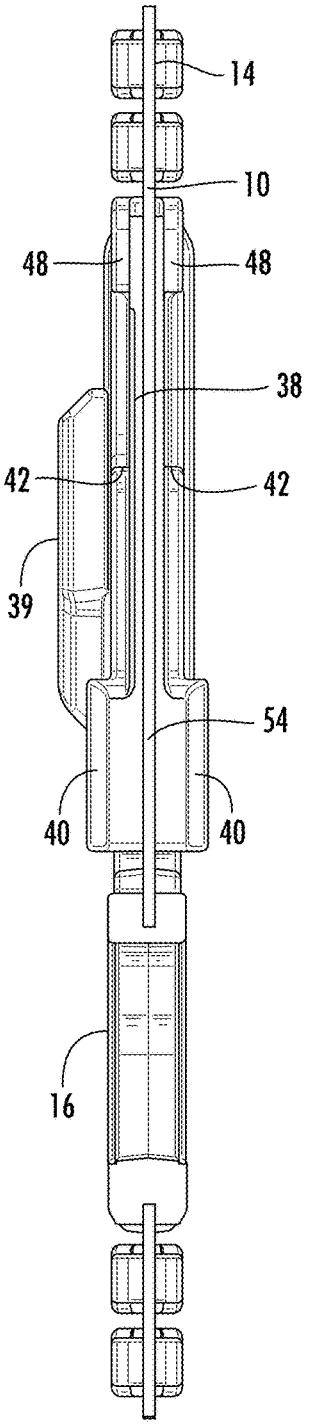
FIG. 4 is a side view of a portion of a first of the tapes of the slide fastener assembly of FIG. 1.

As shown in FIGS. 4-5, the edges 54, 56 of the tapes 10, 11 are exposed. As such, when the slider 12 interacts with the top stops 16, 18 of the tapes 10, 11, top stops 16, 18 compress the edges 54, 56 of the tapes 10, 11 to provide a watertight and/or airtight seal by press bonding. In particular, edges 27, 29 of the extensions 20, 24 and edges 23, 25 of the top stops 16, 18 (FIG. 25) compress against each other when the slider 12 is received within the cavity 28. The compression of the top stops 16, 18 in turn supports the press bonding of the tape edges due to the compression of the box 30 and the pin 38.

Figure 28:
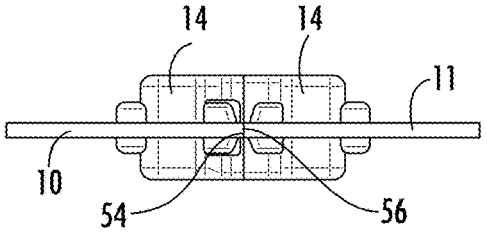
FIG. 28 is a cross-sectional view of the portion of the elements shown in FIG. 27, taken along the line A-A.

Similarly, as also shown in FIGS. 4-5, the edges 54, 56 of the tapes 10, 11 are exposed at the side of the box 30 and the side of the pin 38. As such, when the pin 38 is in the received position with respect to the box 30, the pin 38 is compressed with respect to the box 30. In turn, the edges 54, 56 of the tapes 10, 11 along the box 30 and the pin 38 are compressed, providing a water and/or air tight seal. As mentioned above, the compression of the top stops 16, 18 when the slider 12 is received within the top stops 16, 18 also helps compress the tape edges 54, 56 adjacent the box 30 and the pin 38. Moreover, the engagement of the half elements 48 of the pin 38 with the first element 14 immediately above the guide element 34 of the box 30 (illustrated in FIG. 23) further compresses the tape edges 54, 56 and encourages the press bonding of the tape edges and the formation or a water and/or airtight seal. FIG. 28 is a cross-section illustrating the compression of both the edges 54, 56 of the tapes 10, 11 to form a water and/or airtight seal. As mentioned above, the slide fastener assembly 8 is not limited for use with applications requiring a water and/or airtight seal and thus the top stops 16, 18 can be configured differently.

Different arrangements of the components depicted in the drawings or described above, as well as components and steps not shown or described are possible. Similarly, some features and subcombinations are useful and may be employed without reference to other features and subcombinations. Examples of the invention have been described for illustrative and not restrictive purposes, and alternative examples will become apparent to readers of this patent. For example, the slide fastener described above can be used in any desired application and is not limited to those requiring a water and/or air tight seal. Accordingly, the present invention is not limited to the examples described above or depicted in the drawings, and various embodiments and modifications can be made without departing from the scope of the claims below.

The invention claimed is:

1. A slide fastener assembly comprising:

(a) a first tape comprising a top side, a bottom side, edges and a plurality of elements;

(b) a second tape comprising a top side, a bottom side, edges and a plurality of elements;

(c) a pin comprising a first face on the top side of the first tape and a second face on the bottom side of the first tape, each of the first and second faces comprising:

a pin top edge, a pin bottom edge opposite the pin top edge, a pin first lateral edge between the pin top edge and the pin bottom edge, and a pin second lateral edge between the pin top edge and the pin bottom edge and opposite the pin first lateral edge;

an outer surface;

an insertion area raised relative to the outer surface; and a contour between the pin top edge and a top edge of the insertion area, wherein the contour defines a pin engaging portion; and (d) a box that is integral with the second tape and that comprises a first portion on the top side of the second tape and a second portion on the bottom side of the second tape, the box comprising:

a box top edge, a box bottom edge opposite the box top edge, a box first lateral edge between the box top edge and the box bottom edge, and a box second lateral edge between the box top edge and the box bottom edge and opposite the box first lateral edge;

a cavity that separates an inner surface of the first portion from an inner surface of the second portion; and a contour between the box top edge and an edge adjacent a top of the cavity, wherein the contour defines a box engaging portion, wherein the box engaging portion abuts the pin engaging portion when the insertion area of the pin is received in the cavity of the box, and wherein at least part of the contour of the pin is located between the pin first lateral edge and the pin second lateral edge.

2. The slide fastener assembly of claim 1, wherein the cavity of the box comprises a lower snap mechanism and an upper strength member that are stepped relative to one another.

3. The slide fastener assembly of claim 1, wherein the box first lateral edge forms at least part of the contour of the box.

4. The slide fastener assembly of claim 1, wherein each of the first and second faces of the pin further comprises a half element that is received within a respective cavity of a guide element of the box when the pin is received within the cavity of the box.

5. The slide fastener assembly of claim 4, wherein the half element of each of the first and second faces of the pin is proximate the pin top edge and wherein the respective guide elements of the box are proximate the box top edge.

6. The slide fastener assembly of claim 4, wherein the half element of each of the first and second faces of the pin is received at approximately a 90 degree angle within the respective cavity of the guide element.

7. The slide fastener assembly of claim 1, wherein a handle portion projects beyond the pin first lateral edge.

8. The slide fastener assembly of claim 1, wherein the edge adjacent the top of the cavity of the box comprises a straight portion having a length that is at least as long as a width of a rear mouth of a slider.

9. A slide fastener assembly comprising:

(a) a first tape comprising a plurality of elements;

(b) a second tape comprising a plurality of elements;

(c) a pin comprising at least one face on the first tape, the at least one face comprising:

a pin top edge, a pin bottom edge opposite the pin top edge, a pin first lateral edge between the pin top edge and the pin bottom edge, and a pin second lateral edge between the pin top edge and the pin bottom edge and opposite the pin first lateral edge;

an insertion area raised relative to a surface of the at least one face;

a contour of the surface of the at least one face between the pin top edge and a top edge of the insertion area, wherein the contour defines a pin engaging portion; and a half element adjacent the pin top edge;

(d) a box that is integral with the second tape, the box comprising:

a box top edge, a box bottom edge opposite the box top edge, a box first lateral edge between the box top edge and the box bottom edge, and a box second lateral edge between the box top edge and the box bottom edge and opposite the box first lateral edge;

a cavity;

an edge adjacent a top of the cavity, wherein the edge comprises a straight portion; and a contour between the box top edge and the edge adjacent the top of the cavity, wherein the contour comprises a box engaging portion; and (e) a slider comprising a top wing, a bottom wing, flanges extending from at least one of the top wing and the bottom wing, a connecting neck joining the top wing and the bottom wing, and a rear mouth having a width, wherein the width of the rear mouth of the slider is equal to or longer than a length of the straight portion of the edge adjacent the top of the cavity, wherein when the insertion area of the pin has been received in the cavity of the box, the box engaging portion abuts the pin engaging portion and the rear mouth of the slider is disposed at the straight portion of the edge adjacent the top of the cavity, and wherein at least part of the contour of the pin is located between the pin first lateral edge and the pin second lateral edge.

10. The slide fastener assembly of claim 9, wherein the cavity of the box comprises a lower snap mechanism and an upper strength member that are stepped relative to one another.

11. The slide fastener assembly of claim 10, wherein the upper strength member projects further into the cavity than the lower snap mechanism.

12. The slide fastener assembly of claim 9, wherein the box first lateral edge forms at least part of the contour of the box.

13. The slide fastener assembly of claim 9, wherein the half element is received within a respective cavity of a guide element of the box at a 90 degree angle when the pin is received within the cavity of the box.

14. The slide fastener assembly of claim 9, wherein the insertion area includes an edge with a taper.

15. The slide fastener assembly of claim 9, wherein a handle portion projects beyond the pin first lateral edge.

16. The slide fastener assembly of claim 9, wherein the connecting neck of the slider abuts the half element of the pin when the rear mouth of the slider rests along the straight portion of the edge of the box adjacent the top of the cavity.

17. The slide fastener assembly of claim 9, wherein the pin disengages from the box when the rear mouth of the slider contacts the engaging portion of the pin and pushes the engaging portion of the pin away from the engaging portion of the box.

* * * * *